US006783398B2

(12) United States Patent
Slack et al.

(10) Patent No.: US 6,783,398 B2
(45) Date of Patent: Aug. 31, 2004

(54) SHIELDED MODULAR JACK ASSEMBLY FOR ETHERNET APPLICATIONS

(75) Inventors: Victor E. Slack, Lewisville, NC (US); Eric C. Laurer, Clemmons, NC (US); Daniel R. Lewis, Incline Village, NV (US); Kenneth Koon Keung Lai, Hung Hom (HK)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/196,691

(22) Filed: Jul. 16, 2002

(65) Prior Publication Data

US 2004/0014362 A1 Jan. 22, 2004

(51) Int. Cl.[7] ..... H01R 13/66
(52) U.S. Cl. ..... 439/620
(58) Field of Search ..... 439/76.1, 620, 439/676

(56) References Cited

U.S. PATENT DOCUMENTS

| | | | | |
|---|---|---|---|---|
| 5,531,612 A | | 7/1996 | Goodall et al. | 439/541.5 |
| 5,647,767 A | * | 7/1997 | Scheer et al. | 439/620 |
| 5,736,910 A | * | 4/1998 | Townsend et al. | 333/181 |
| 6,227,911 B1 | | 5/2001 | Boutros et al. | 439/620 |

* cited by examiner

*Primary Examiner*—Renee Luebke
*Assistant Examiner*—Ann McCamey

(57) ABSTRACT

An electrical connector assembly is shown which includes both full shielding and signal conditioning. The assembly includes a front housing portion in the form of a modular jack, and a rear housing portion which forms a recessed area or "well" for receiving the components for signal conditioning. The components are mounted on a printed circuit board, and placed in the recessed area. The housings are aligned and locked together.

25 Claims, 15 Drawing Sheets

SHIELDED MODULAR JACK ASSEMBLY FOR ETHERNET APPLICATIONS

BACKGROUND OF THE INVENTION

The invention relates to a connection assembly providing signal conditioning and superior shielding for high speed data applications.

Known connector assemblies exist having multiple receptacle connectors in a common housing, which provides a compact arrangement of such receptacle connectors. Such a connector assembly is useful to provide multiple connection ports. Accordingly, such a connector assembly is referred to as a multiple port connector assembly. In preferred arrays, the housing has jacks one above the other, forming a plurality of arrays in stacked arrangement, so-called stacked jack arrangements. The receptacle connectors, that is, modular jacks, each have electrical terminals arranged in a terminal array, and have plug receiving cavities. Specifically, the receptacle connectors are in the form of RJ-45 type modular jacks that establish mating connections with corresponding RJ-45 modular plugs.

For example, as disclosed in U.S. Pat. No. 5,531,612, a connector assembly has two rows of receptacle connectors, that is, modular jacks, arranged side-by-side in an upper row and side-by-side in a lower row in a common housing, which advantageously doubles the number of receptacle connectors without having to increase the length of the housing. The receptacle connectors have plug-receiving sections with plug receiving cavities that are profiled to surround modular plugs that are to be inserted in the cavities. The modular plugs have resilient latches, which engage with latching sections on the modular jacks. The latches are capable of being grasped by hand, and being resiliently bent inwardly toward the plugs to release them from engagement with the latching sections on the modular jacks.

Such connection systems have found utility in office computer networks, where desktops are interconnected to office servers by way of sophisticated cabling. Such networks have a variety of data transmission medium including coaxial cable, fiber optic cable and telephone cable. One such network topography is known as the Ethernet network, which is subject to various electrical standards, such as IEEE 802.3 and others. Such networks have the requirement to provide a high number of distributed connections, yet optimally requires little space in which to accommodate the connections.

Furthermore, such networks now operate at speeds of 1 gigabit and higher which requires significant conditioning to the signals. For instance, it is common to require shielding for controlling electromagnetic radiation per FCC standards, while at the same time controlling electromagnetic interference (EMI) within the assembly, between adjacent connections. It is therefore also a requirement to provide such components within the assembly as magnetic coils, inductors, chip capacitors, and the like, to condition the signals. While the technology exists for conditioning the signals, no connection devices exist which are capable of handling such speeds, while at the same time package the signal conditioning components required to maintain these speeds.

Another design is shown in U.S. Pat. No. 6,227,911 to Boutros et al., which discloses a modular jack assembly having multiple ports for connection to multiple modular jacks. While this assembly further discloses having packaged magnetic assemblies, or other components, this design, as in other attempts to signal condition connection devices, simply adds the components to known connection devices. Therefore the volume within the assembly is inadequate to provide the proper signal conditioning devices for the high speeds now required.

The objects of the inventions are therefore to overcome the shortcomings of the prior art.

SUMMARY OF THE INVENTION

The objects of the invention have been accomplished by providing an electrical connector having signal conditioning, where the connector comprises an electrical connector housing assembly comprised of a front housing portion having a mating face for matingly receiving a complementary connector, and a housing component receiving portion having a receiving area for receiving signal conditioning components. A plurality of electrical contacts are positioned in the housing, with mating contact portions adjacent said mating face for contact with the complementary connector, and connecting portions extending into the receiving area. A plurality, of signal conditioning components are positioned in the receiving area, with a plurality of conductor portions positioned in the receiving area interconnecting the connecting portions and the signal conditioning components. A shielding mechanism at least partially surrounds the electrical connector housing assembly, the shield member having a foot portion extending into the receiving area, and in electrical contact with at least one of the signal conditioning components.

Preferably, the front housing portion and the housing component receiving portion are separate housing portions. The shielding mechanism is comprised of a front shielding portion, surrounding the front housing portion, and a rear shielding portion, surrounding the component receiving housing portion. The front shielding portion is comprised of a plurality of shielding walls surrounding the front housing portion, with one of the shielding walls including said contact foot which extends into the receiving portion. The rear shielding portion is comprised of a plurality of shielding walls surrounding the component receiving housing portion, the rear shielding portion being positioned adjacent to the contact foot to enclose the housing component receiving portion.

The receiving area is defined by a floor and an upstanding perimeter wall, thereby defining an open upper face. The conductor portions are defined as circuit traces on a printed circuit board, with the signal conditioning components being positioned on the printed circuit board, with the perimeter wall being profiled to receive the printed circuit board therein. The connecting portions extend along, and are spaced from, a rear face of the front housing portion, whereby the front housing portion and the component receiving housing portion are assembled together, with a front wall portion of the upstanding perimeter wall extending between the connecting portions and the rear face of the front housing portion. The rear face is recessed and the side walls of the front housing portion partially overlap the perimeter wall.

The front shield member is comprised of a rear wall shielding a portion of the connecting portions, and a tab portion extending from the rear wall and partially overlying the open upper face. The conductor portions are defined as circuit traces on a printed circuit board, with the signal conditioning components being positioned on the printed circuit board, with the perimeter wall being profiled to receive the printed circuit board therein. The contact foot extends vertically downward from the tab portion through the open upper face. The rear shielding portion includes a top shielding wall enclosing the open upper face, which extends to the tab portion, to define substantially enclosed seams.

In another aspect of he invention, a signal conditioned electrical connector comprises an electrical connector housing assembly comprised of a first housing portion having a mating face for matingly receiving a complementary connector, and a second housing portion having a receiving area defined by a floor and an upstanding perimeter wall, for receiving signal conditioning components. A plurality of electrical contacts are positioned on the first housing portion, having contact portions adjacent the mating face for contact with the complementary connector, and connecting portions extending into the receiving area. A plurality of signal conditioning components are positioned in the receiving area, and a plurality of conductor portions are positioned in the receiving area interconnecting the connecting portions and the signal conditioning components. A shielding mechanism at least partially surrounds the electrical connector housing assembly.

In the preferred embodiment of the invention, the shield member has a foot portion extending into the receiving area, which is in electrical contact with at least one of the signal conditioning components. The front housing portion and the housing component receiving portion are separate housing portions. The shielding mechanism is comprised of a front shielding portion, surrounding the front housing portion, and a rear shielding portion, surrounding the component receiving housing portion. The front shielding portion is comprised of a plurality of shielding walls surrounding the front housing portion, with one of the shielding walls including a contact foot extending into the receiving portion. The rear shielding portion is comprised of a plurality of shielding walls surrounding the component receiving housing portion, where the rear shielding portion is positioned adjacent to the contact foot to enclose the housing component receiving portion.

The receiving area is defined by a floor and an upstanding perimeter wall, thereby defining an open upper face. The conductor portions are defined as circuit traces on a printed circuit board, with the signal conditioning components being positioned on the printed circuit board, with the perimeter wall being profiled to receive the printed circuit board therein. The connecting portions extend along, and are spaced from, a rear face of the front housing portion, whereby the front housing portion and the component receiving housing portion are assembled together, with a front wall portion of the upstanding perimeter wall extending between the connecting portions and the rear face of the front housing portion. The rear face is recessed and the side walls of the front housing portion partially overlap the perimeter wall. The front shield member is comprised of a rear wall shielding a portion of the connecting portions, and a tab portion extending from the rear wall and partially overlying the open upper face. The contact foot extends vertically downward from the tab portion through the open upper face. The rear shielding portion includes a top shielding wall enclosing the open upper face, which extends to the tab portion, to define substantially abutting seams.

DETAILED DESCRIPTION OF THE PREFERRED EMBODIMENT

Figure 1:
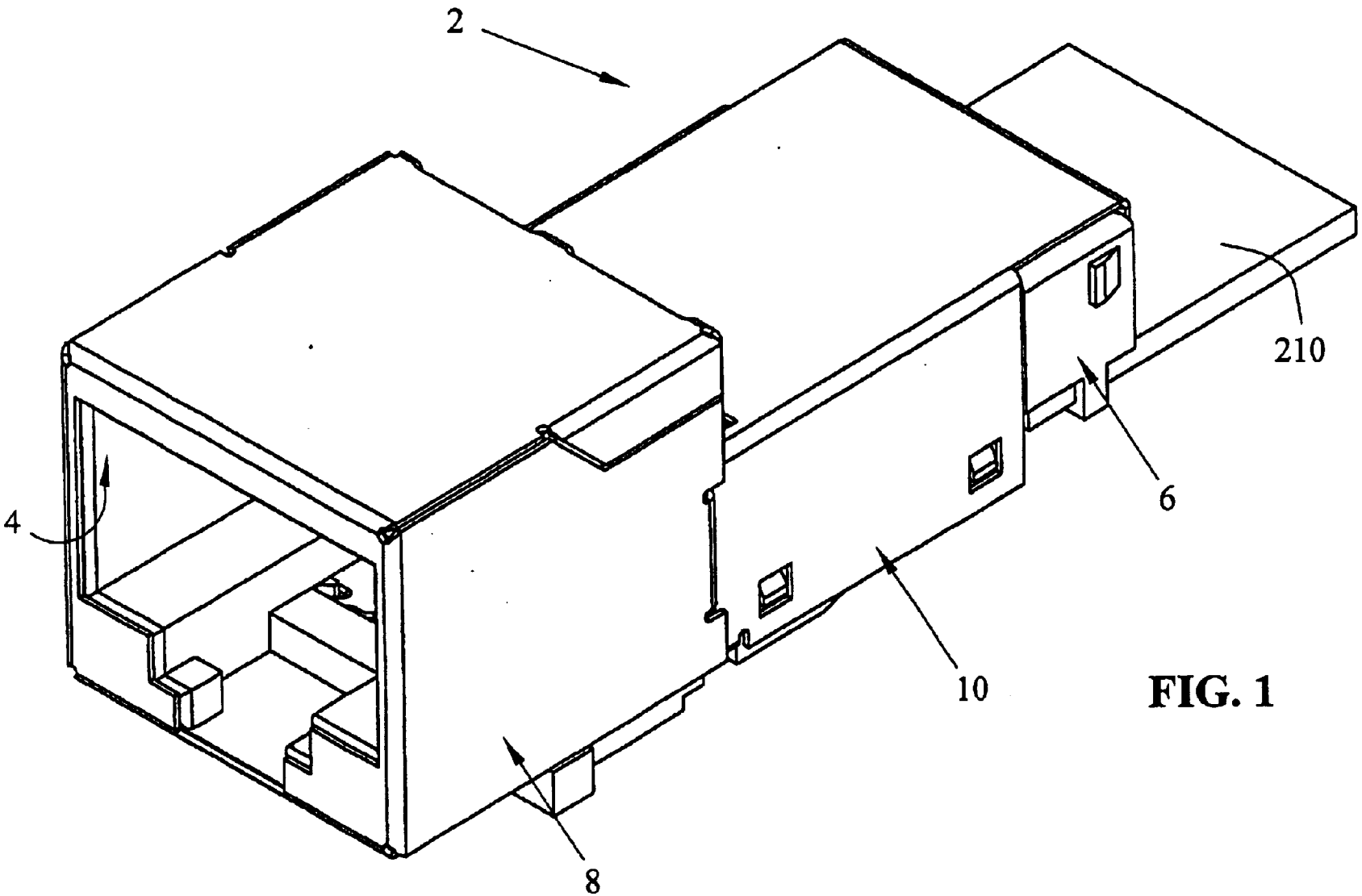
FIG. 1 is a front perspective view of the modular jack assembly.
Figure 2:
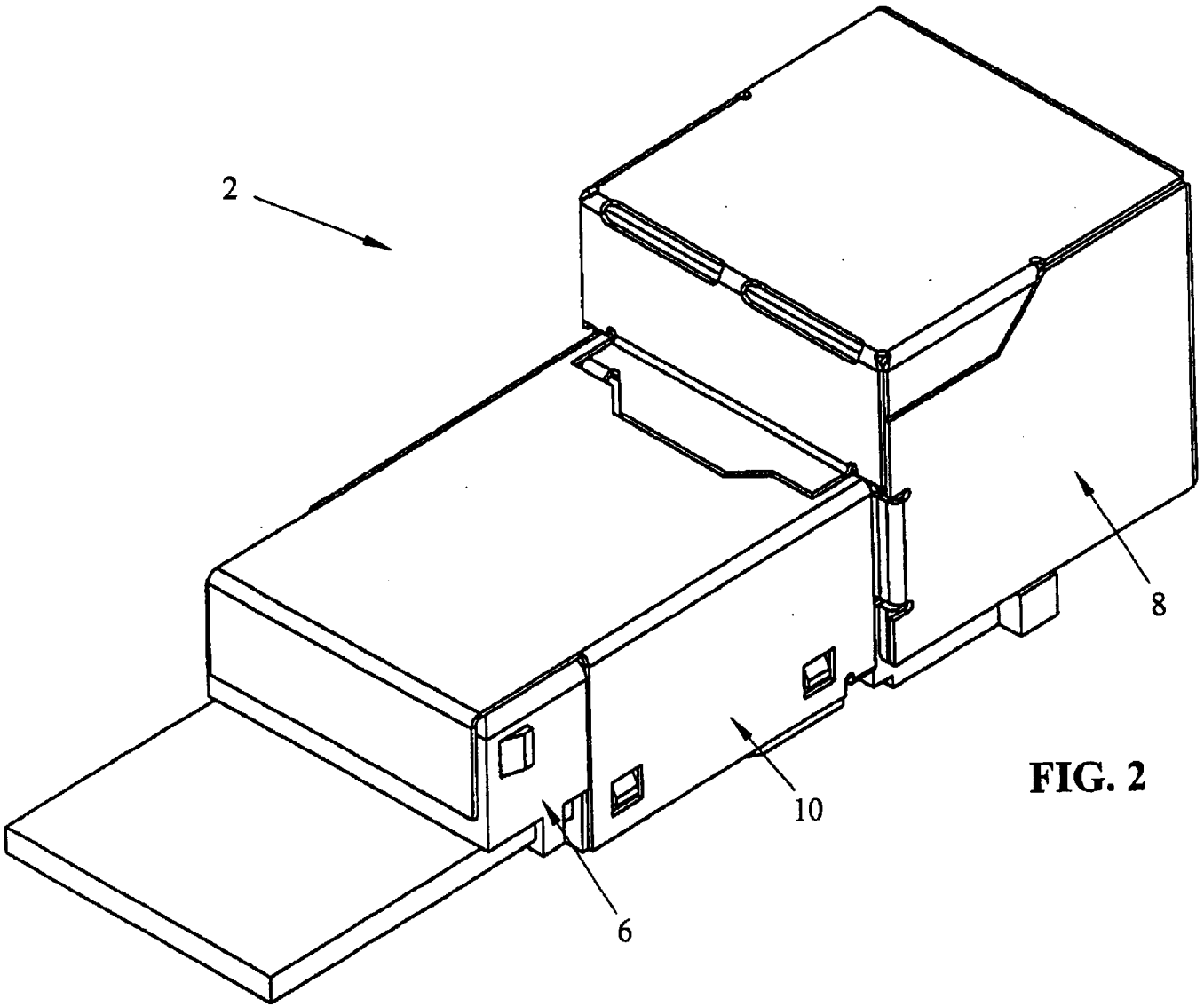
FIG. 2 is a rear perspective view of the assembly shown in FIG. 1.
Figure 3:
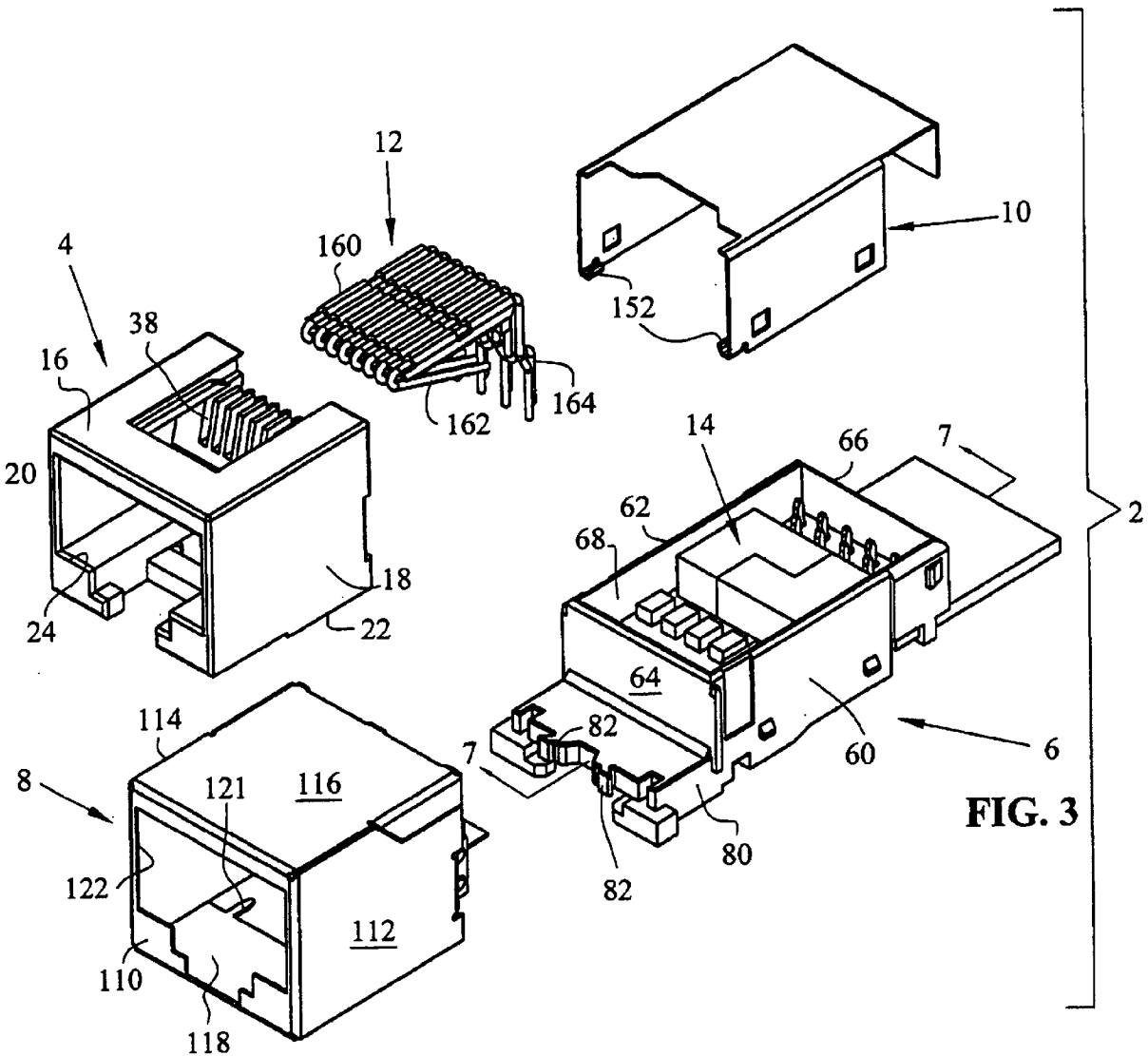
FIG. 3 is an exploded view of the modular jack assembly of FIGS. 1 and 2.
Figure 4:
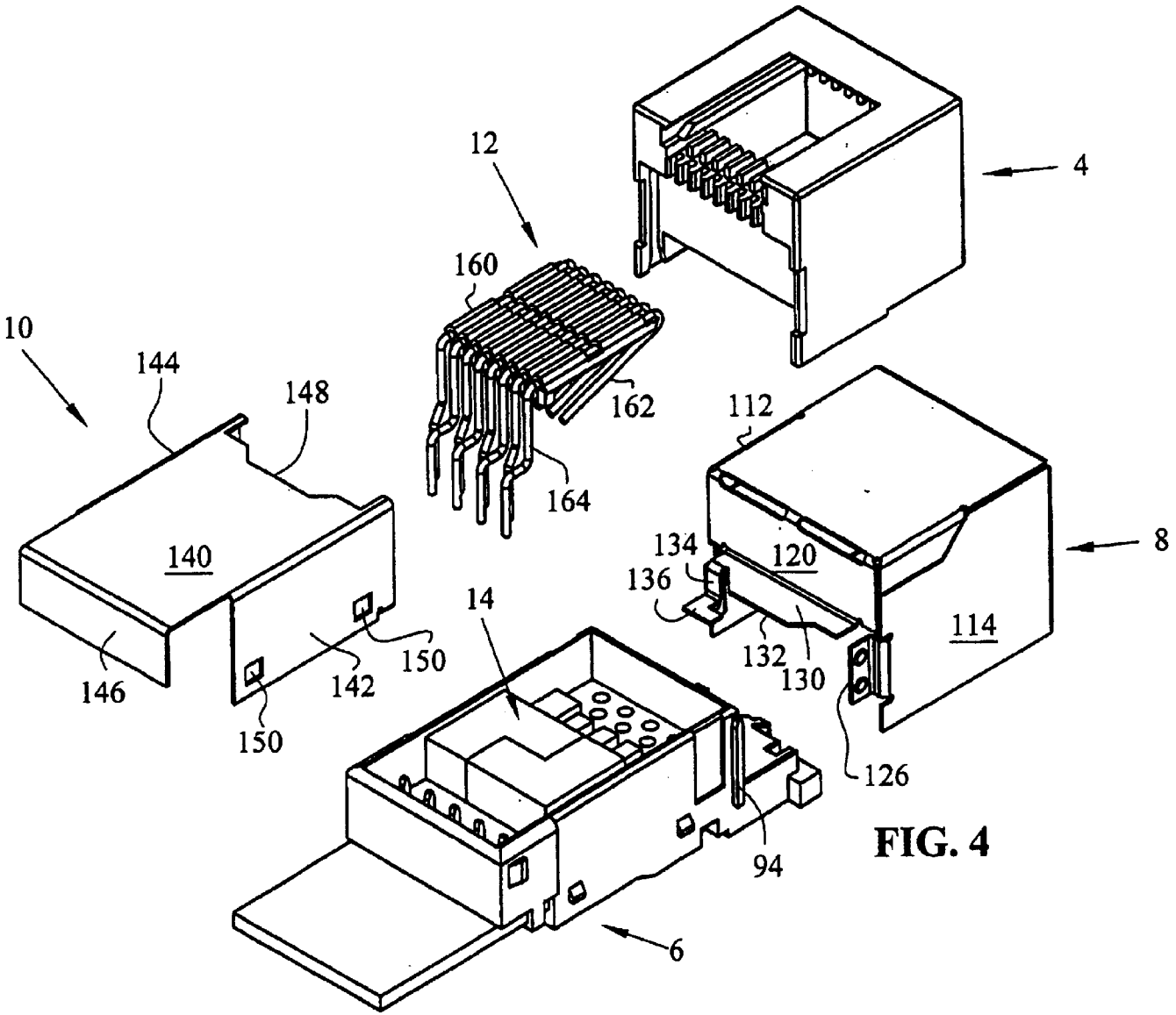
FIG. 4 is an exploded rear perspective view showing the modular jack of FIGS. 1 and 2 exploded.

With reference first to FIGS. 1 and 2, a modular jack assembly is shown generally at 2 and includes a front housing portion 4, a rear housing portion 6, a front shield member 8, and a rear shield portion 10. Preferably the front housing portion 4 and rear housing portion 6 are molded from a plastic insulative material, whereas the front and rear shield members 8, 10 are stamped and formed from a metallic material suitable for shielding purposes. However, it should be appreciated that other types of shielding are also possible, such as laminated materials, plated plastics, and the like. As shown in FIGS. 3 and 4, the modular jack subassembly 2 further includes a terminal insert 12, and the rear housing portion 6 is utilized for retaining a signal conditioning assembly shown best at 14.

Figure 5:
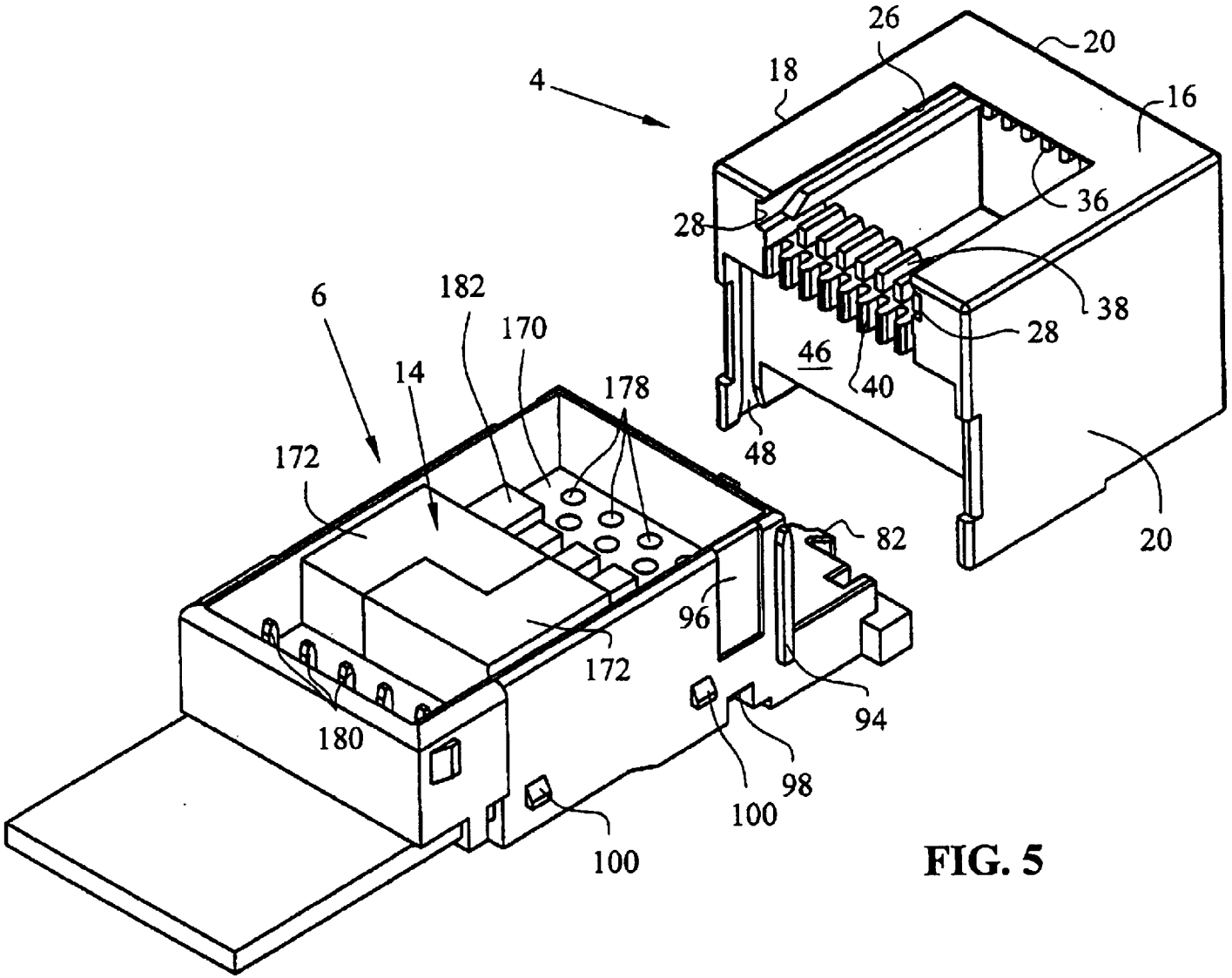
FIG. 5 is a rear perspective view of the housing subassembly of the modular jack of FIGS. 1 and 2.
Figure 6:
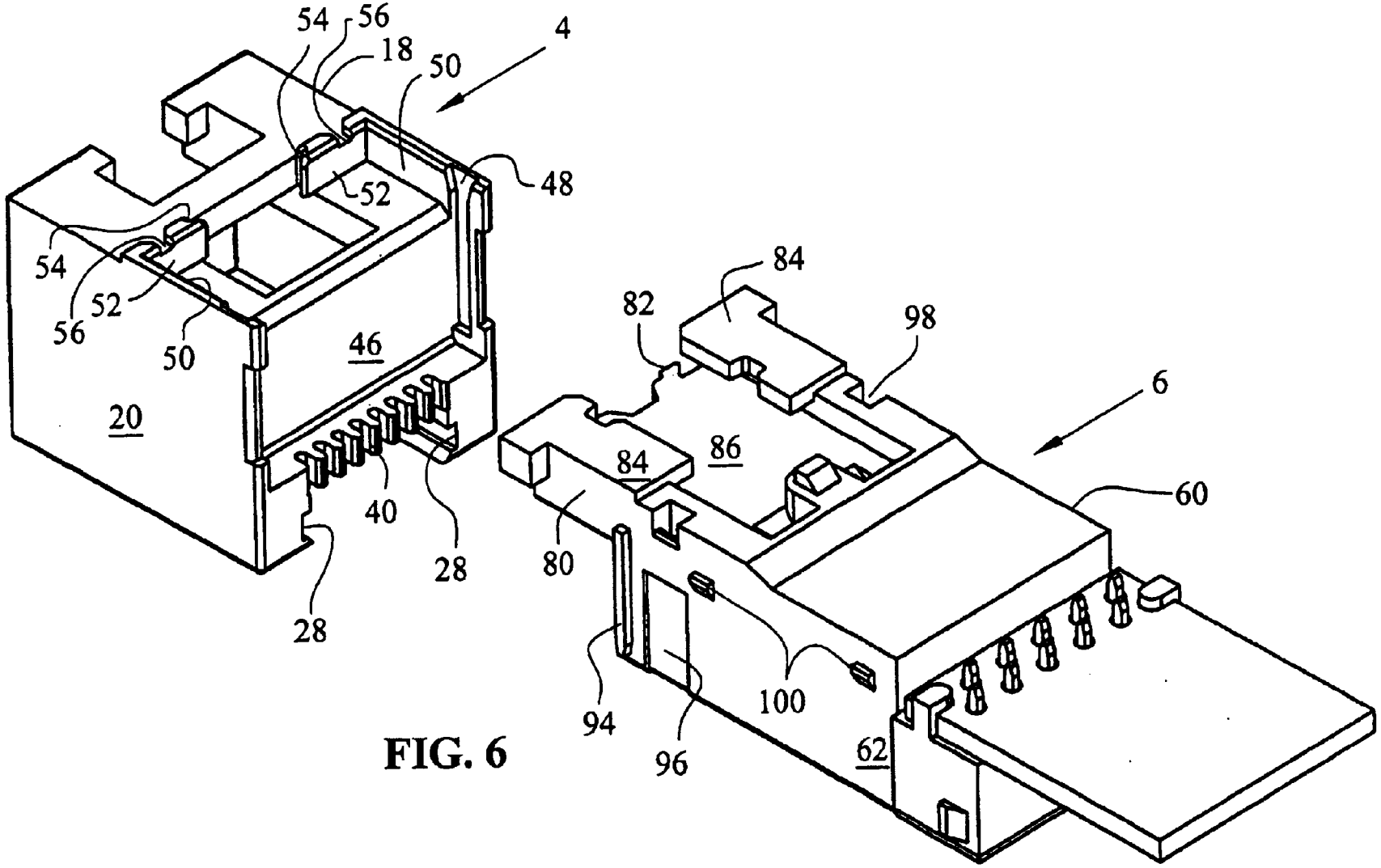
FIG. 6 is a perspective view of the underside of the housing subassembly of FIG. 5.

With respect now to FIGS. 3, 5 and 6, the front housing portion 4 will be described in greater detail. With reference first to FIG. 3, the housing 4 generally includes a top wall 16, side walls 18, 20, and a lower wall at 22. Front wall 20 includes an opening at 24 profiled for the receipt of a modular plug as should be understood to those skilled in the art. As shown in FIG. 5, top wall 16 includes an opening at 26, which defines two channels 28 flanking the opening 26. Each of the channels 28 includes a positioning ledge at 30, as will be described in greater detail herein.

With respect still to FIG. 5, housing 4 includes forward terminal aligning walls 36 adjacent front face 20, rear aligning walls 38, and terminal aligning grooves at 40. The rear face of housing 4 is recessed at 46 and the inside surfaces of walls 18, 20 include grooves at 48, as will be described herein. Finally, as shown best in FIG. 6, side walls 18 and 20 have lower L-shaped extensions defined by longitudinal sections 50 and transverse sections 52. The free ends of the transverse sections 52 include a dovetail configuration shown best at 54, as will be described further herein. Notches 56 are also positioned adjacent to dovetail configuration, as best shown in FIG. 6.

Figure 7:
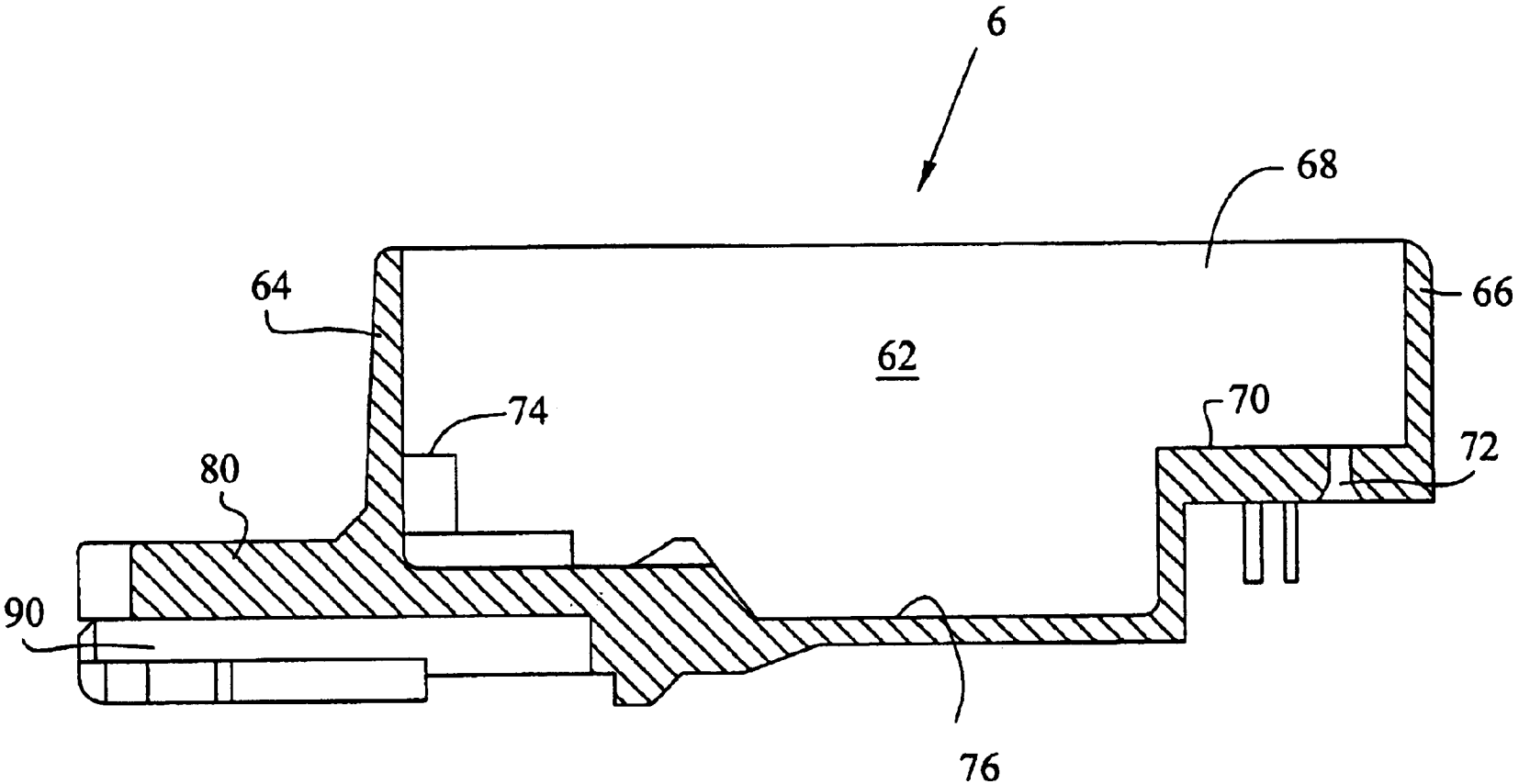
FIG. 7 is a cross-sectional view through lines 7—7 of FIG. 3.

With respect again to FIGS. 3–7, the rear housing 6 will be described in greater detail. Rear housing 6 includes side walls 60, 62, front wall 64, and rear wall 66. Side walls 60, 62 and front and rear walls 64, 66 are of generally common height so as to form an enclosure 68 therein. Within the enclosure 68, and as best shown in FIG. 7, a rear ledge portion 70 is positioned having terminal receiving throughholes at 72. At the front side of enclosure 68 is a further upstanding pedestal support 74, which has a substantially common height as floor 70. Finally, a deep well section is formed at 76, which forms a component receiving section, as will be described herein. With respect now to FIGS. 3, 6 and 7, housing 6 includes a forwardly extending ledge portion at 80, where the front end includes dovetail flanges at 82, as best shown in FIG. 3. Extension 80 also includes wing portions 84, which are spaced from a downwardly facing surface 86, which defines a slot 90 therebetween. With respect to FIG. 6, side walls 60 and 62 include vertical ribs 94, indentations at 96, slots at 98, and latching detents at 100.

With respect now to FIGS. 3 and 4, front shield 8 will be described in greater detail. With respect first to FIG. 3, shield 8 includes a front wall 110, side walls 112 and 114, top wall 116, lower wall 118, and rear wall 120. Lower wall 118 includes alignment tines 121 extending therefrom. As should be appreciated by those skilled in the art, front face 110 includes an opening 122 substantially profiled as opening 24, so as to allow entry of a modular plug. As shown best in FIG. 4, front shield 8 includes two indented tab portions 126 extending from respective side walls 112 and 114. Rear wall 120 includes a horizontally disposed rear ledge 130 having a discontinuously shaped edge 132, which is shown in a substantially trapezoidal shape, and includes a shielding foot 134 on one side thereof. The shielding foot 134 includes a horizontally disposed contact portion 136, which will be described in greater detail herein.

With respect to FIGS. 3 and 4, rear shield member 10 will be described in greater detail. Rear shield 10 includes a top wall 140, side walls 142, 144, and a rear wall portion 146. The leading edge of top wall 140 includes a discontinuously shaped edge 148, which is profiled to complement edge 132 of shield member 8. Side walls 142 and 144 also include latching openings, such as 150 and side wall tab portions 152 (FIG. 3).

With respect to FIGS. 3 and 4, the terminal insert or lead frame 12 will be described in greater detail. Contact lead frame 12 includes an overmolded web portion 160 having reversely bent plug contacts 162 extending forwardly therefrom, and printed circuit board contact portions 164 extending from a rear of the web 160. It should be appreciated that the contacts 164 are tandemly spaced so as to form two rows of contacts in a back-to-back array. The lead frame could be formed through the process shown in U.S. Pat. No. 4,817,283 and fully incorporated herein by reference.

Finally, signal conditioning assembly 14 will be summarily described, whereas this device is shown and described in more detail in co-pending applications to the same assignee filed on even date, and assigned Ser. Nos. 10/196,302 and 10/196,452 fully incorporated herein by reference. As shown best in FIG. 5, assembly 14 is comprised of a printed circuit board 170 having packaged component assemblies 172. In the preferred embodiment, the assemblies 172 each include three electromagnets. Printed circuit board 170 further includes a plurality of throughholes 178 and a plurality of pin terminals 180. Finally, printed circuit board 170 further includes a plurality of signal conditioning components, including at least one decoupling capacitor shown at 182. It should be appreciated that the circuit board includes printed circuit board traces extending between throughholes 178 through to pin terminals 180 so as to incorporate the components such as 182 and the magnetic coil packages 172 within their paths.

Figure 8:
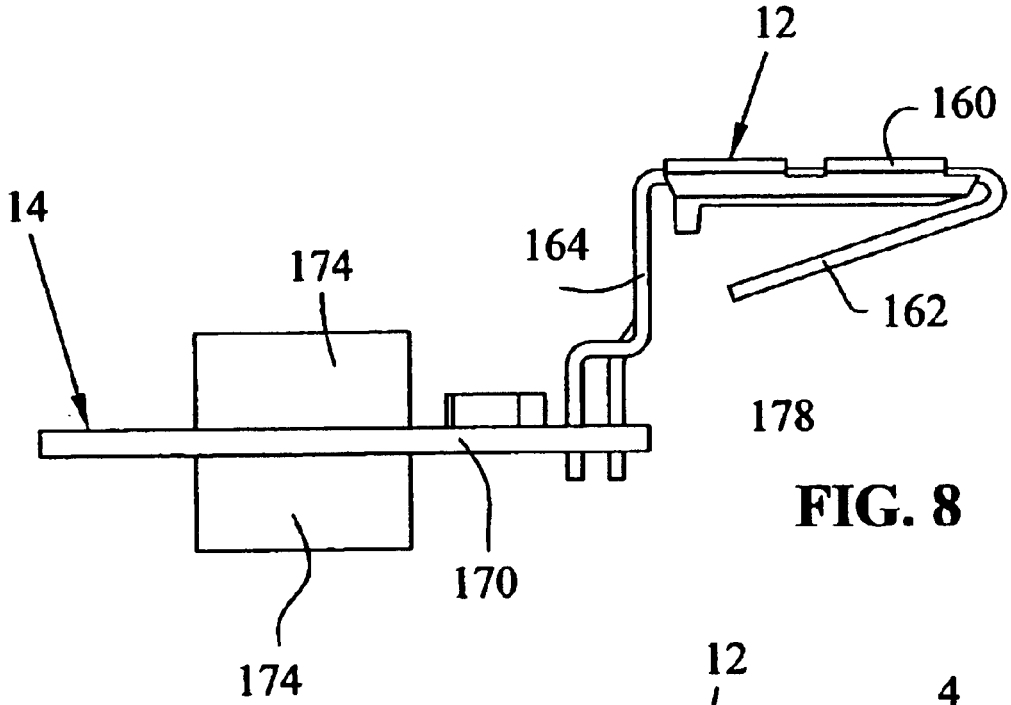
FIGS. 8–14 show progressive views of the assembly of the subject modular jack of FIGS. 1 and 2.
Figure 9:
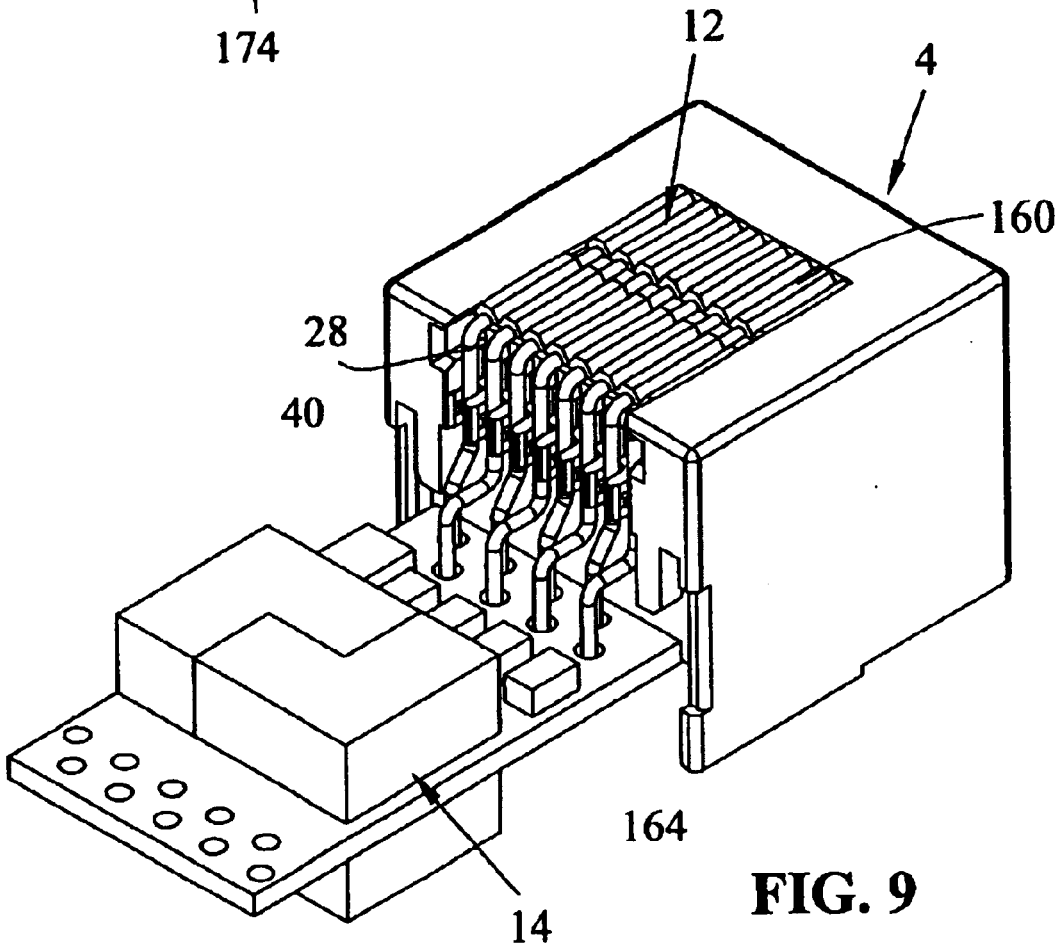

With the components of the assembly 2 as described above, the assembly of the device will now be described with reference to FIGS. 8 through 14. With reference first to FIG. 8, terminal lead frame 12 is positioned with contacts 164 positioned in throughholes 178. It should be appreciated that the contacts 164 would then be soldered or otherwise electrically connected to plated throughholes 178. As shown in FIG. 9, the assembly of the lead frame 12 and printed circuit board assembly 14 is then positioned within housing 4, such that overmolded web 160 is positioned within channels 28 of housing 4. It should be appreciated that terminals 160 will thereafter be positioned adjacent to opening 24 with the tail end of the contacts 162 being positioned in channels 38, and with the contact portions 164 being positioned in the grooves 40, as shown in FIG. 9.

Figure 10:
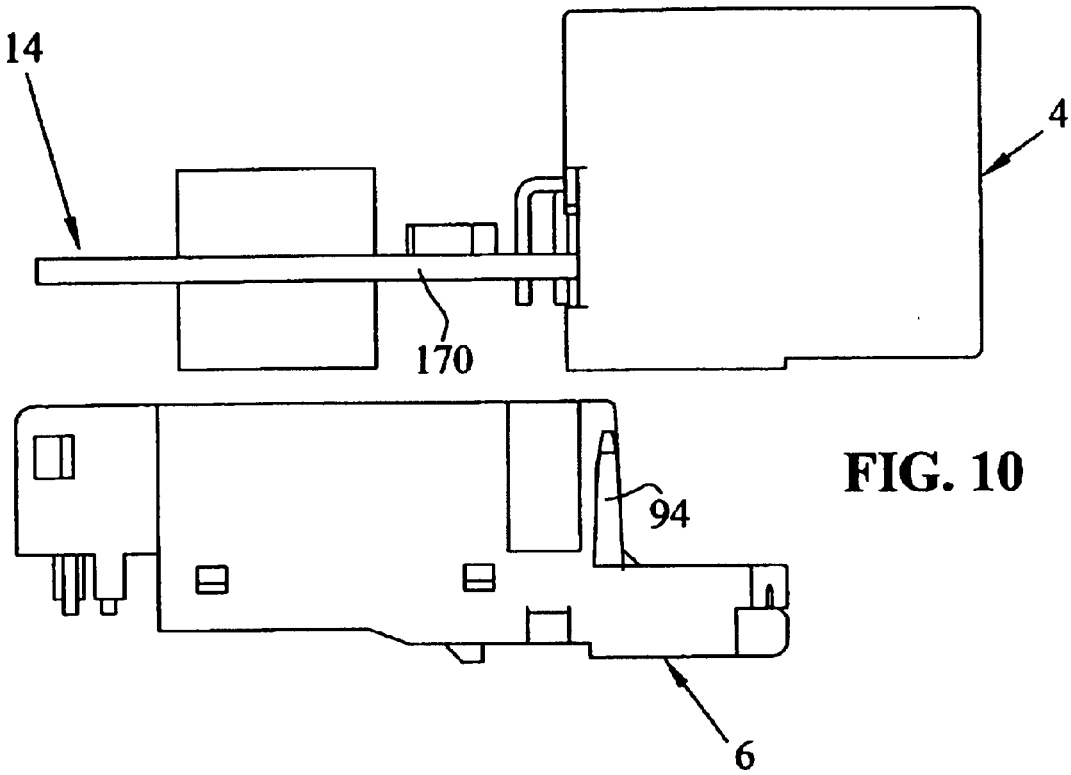
Figure 11:
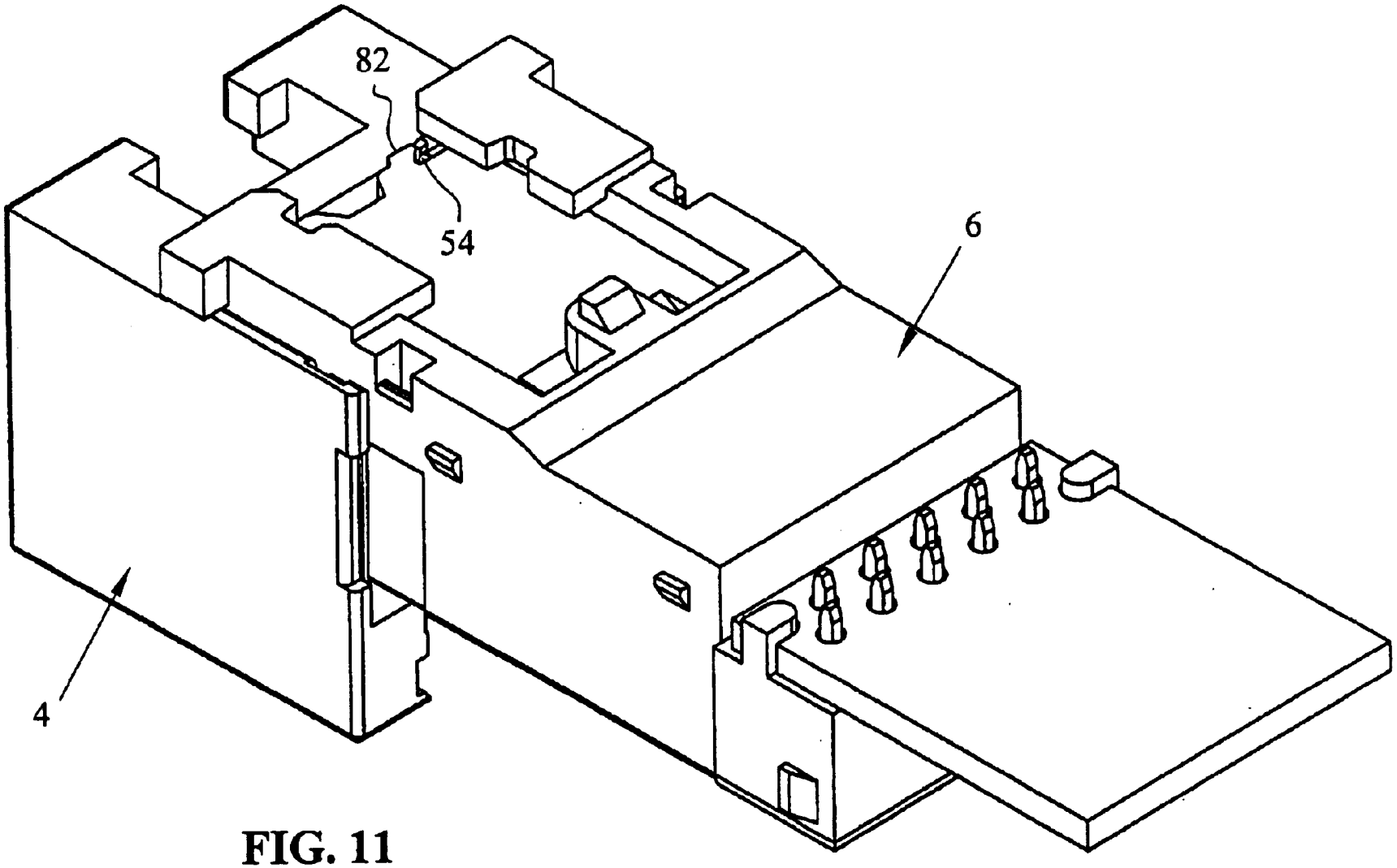

As shown in FIG. 10, the assembly as shown in FIG. 9 is thereafter receivable within rear housing portion 6, such that grooves 48 (FIGS. 5 and 6) receive ribs 94 with printed circuit board 170 being positioned within opening 68 (FIG. 3) of housing portion 6. When the printed circuit board 170 is fully seated within housing 6, the cooperating dovetail configurations 54, 82 are in an overlapping and locking relation, as best shown in FIG. 11. This also positions printed circuit board 170 on ledge 70 and shoulder 74 (FIG. 7).

Figure 12:
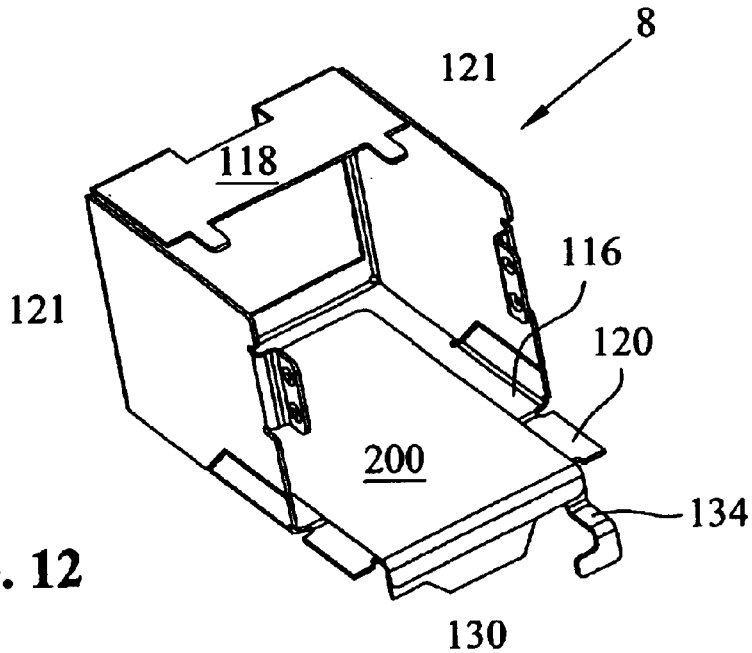

As shown in FIG. 12, the front shield member 8 is shown as an underside perspective view prior to the folding of rear wall portion 120, such that top wall 116 and rear wall 120 are substantially planar. Preferably an insulating film 200 is fixed to the inside surface of top wall 116 and rear wall 120 as shown, so as to partially overlie tab portion 130. It should be appreciated that this prevents shorting contact between the shield and any portion of the terminals of lead frame 12.

Figure 13:
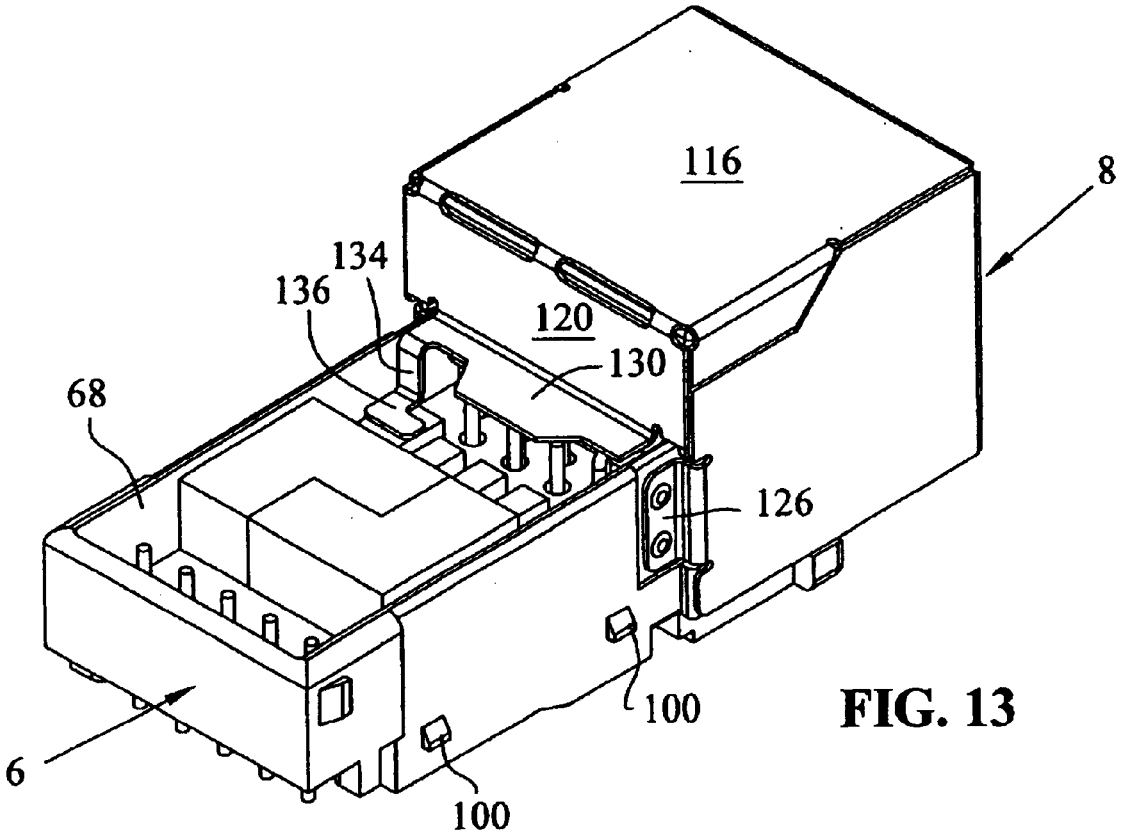

As shown in FIG. 13, the front shield 8 as shown in FIG. 12 may now be slidably received over the assembly shown in FIG. 10 and rear wall portion 120 bent downwardly to substantially cover the rear portion of housing 4. In this position, alignment tines 121 (FIG. 3) align with slots 56 (FIG. 6). This also places tab portions 126 of shield member 8 within apertures 96 (FIG. 6) and places contact foot 136 extending from shield 8 in an overlying manner over decoupling capacitor 182 (FIG. 5). Foot 136 can now be soldered or otherwise interconnected to decoupling capacitor 182. This also places tab portion 130 in a substantially horizontal position partially overlying opening 68 of housing 6. It should be appreciated that potting material or other sealing means is now encapsulated within opening 68 so as to encapsulate all of the terminals and circuitry for sealing purposes.

Figure 14:
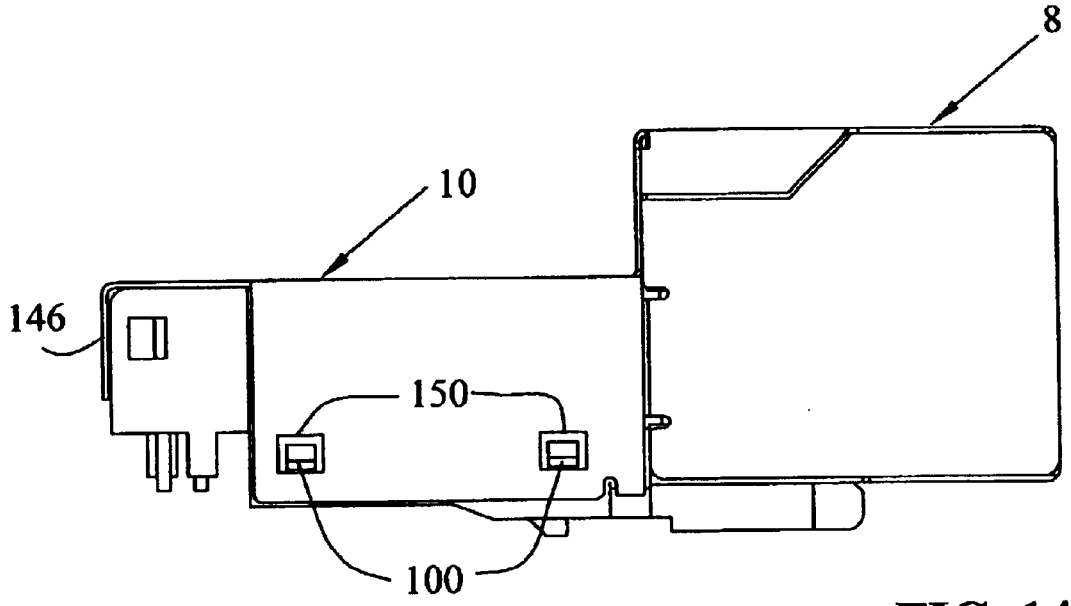
Figure 15:
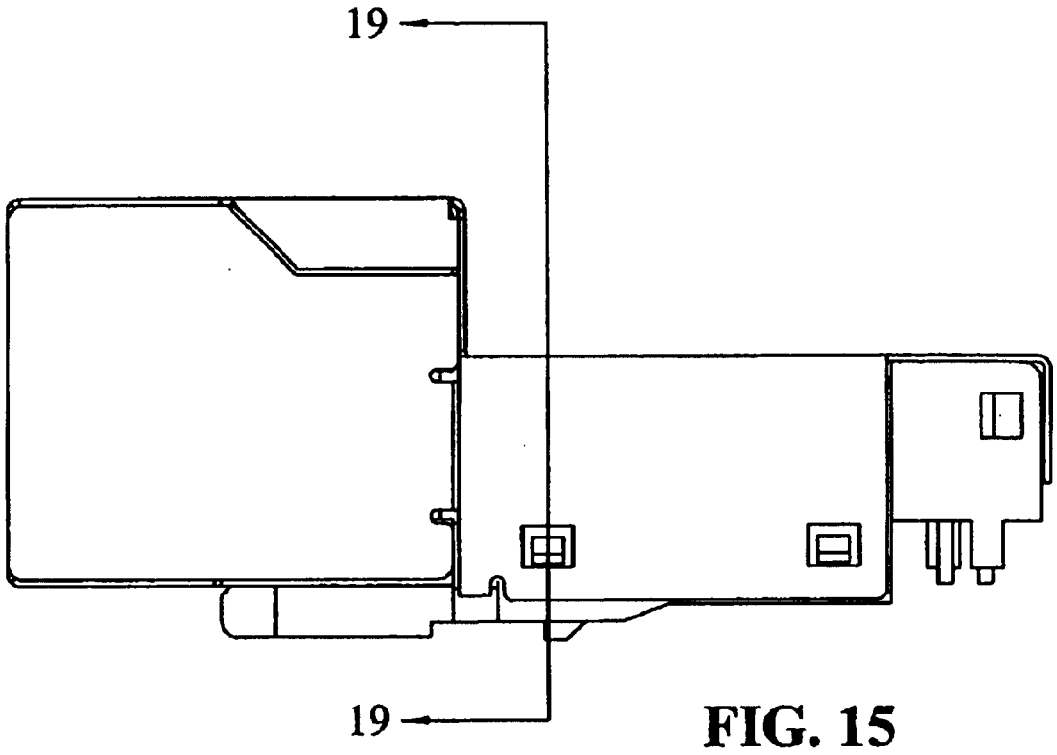
FIG. 15 is a side plan view of the modular jack assembly shown in FIGS. 1 and 2.
Figure 16:
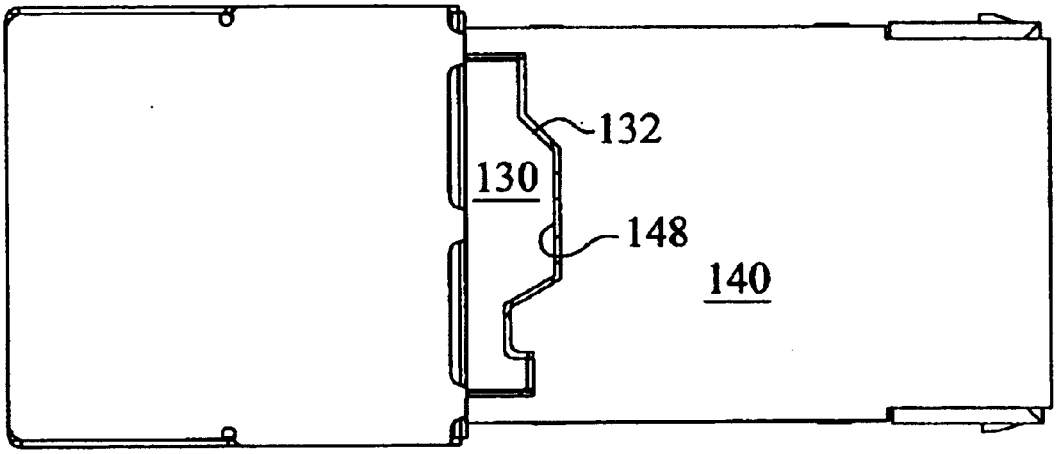
FIG. 16 is a top plan view of the device shown in FIG. 15.
Figure 17:
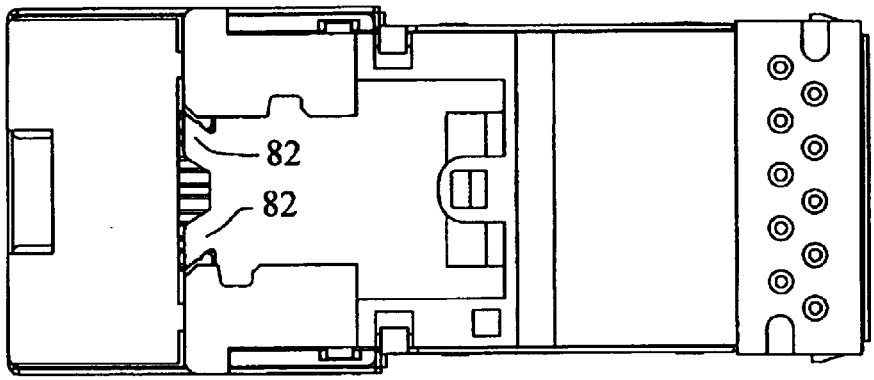
FIG. 17 is a bottom plan view of the device shown in FIG. 15.
Figure 18:
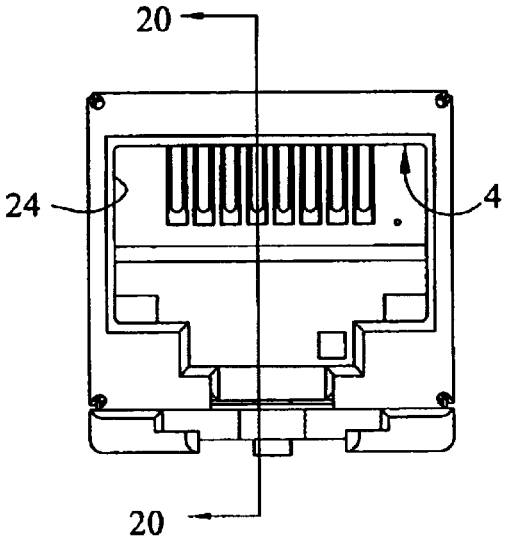
FIG. 18 is a front plan view of the device shown in FIG. 15.
Figure 19:
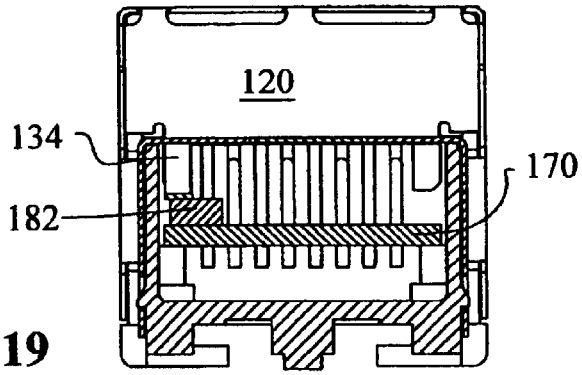
FIG. 19 is a cross-sectional view through lines 19—19 of FIG. 15.
Figure 20:
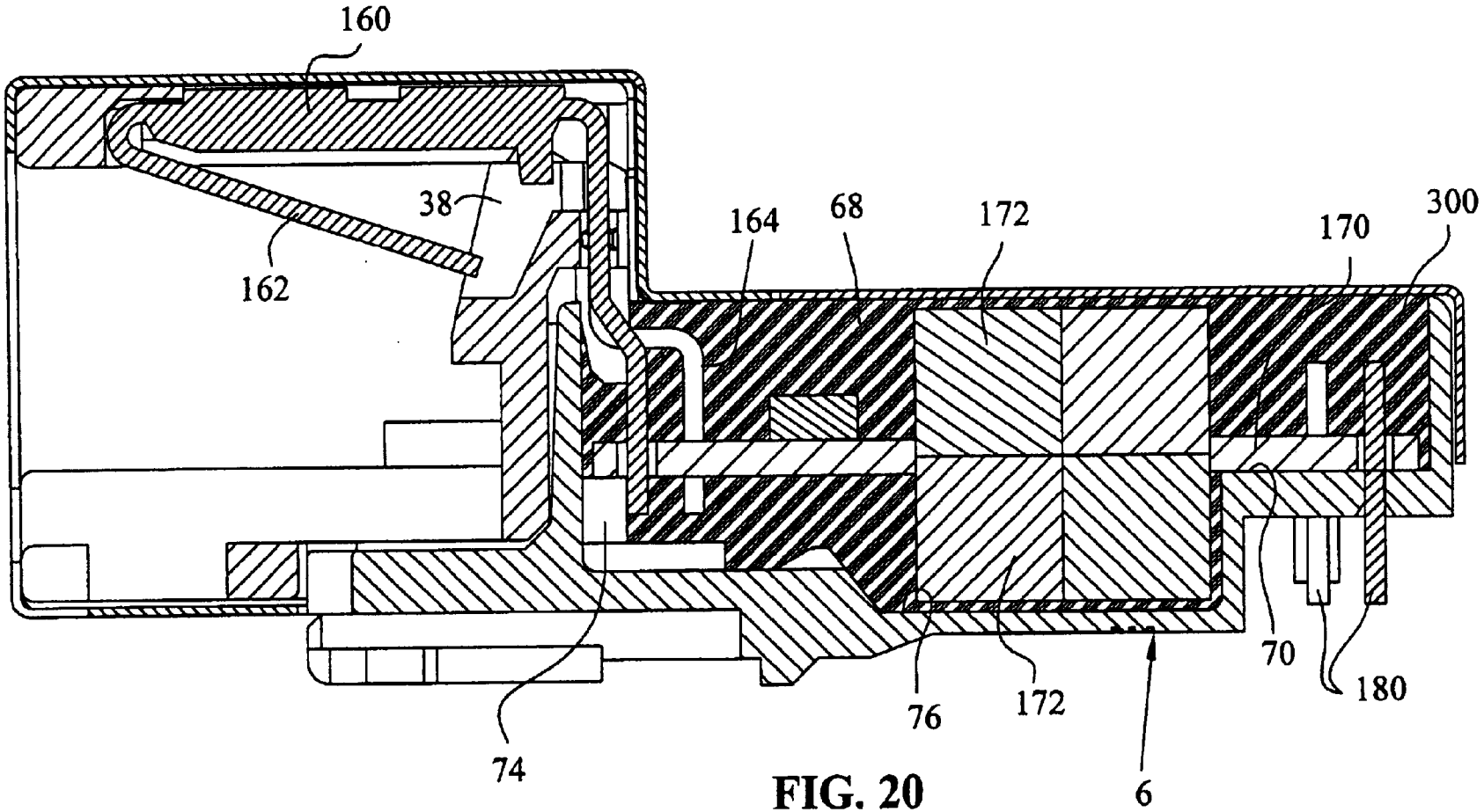
FIG. 20 is a cross-sectional view through lines 20—20 of FIG. 18.

Finally, as shown in FIG. 14, shield member 10 is slidably received over housing portion 6, until apertures 150 snap in place behind latching lugs 100. This positions edge 132 of tab portion 130 within its similarly shaped opening 148, yet maintaining the tab 134 extending downwardly into cavity 68 and contacting decoupling capacitor 182, as best shown in FIGS. 16 and 19. Also as best shown in FIGS. 17, 18 and 20, contacts 162 are disposed adjacent to opening 24 of front housing portion 4 and further positions contact sections 164 within opening 68 of housing 6 and sealed therein. This also positions and packages magnetic coils 172 neatly within the package, with the lower coils 172 being positioned in the lower well section 76, as shown in FIG. 20, with the rear terminal portions 180 available for customer connection.

As designed, the modular jack assembly performs as an interface for Ethernet applications. The design also provides for an efficiently packaged assembly. The two-piece housing assembly allows for the front housing 4 to be profiled as a modular jack housing, whereas the rear housing 6 can be used to house the signal conditioning components. The alignment 48, 94 allows proper alignment of the printed circuit board 170 with the opening 68. The two housing members are locked together by way of the cooperating dovetail configuration 54, 82. Moreover, as the device is both fully shielded, as well as coupled to signal conditioning components, the device can be used at speeds for Ethernet application. The signal conditioning components are shown more clearly by way of schematic in FIG. 21.

Figure 21:
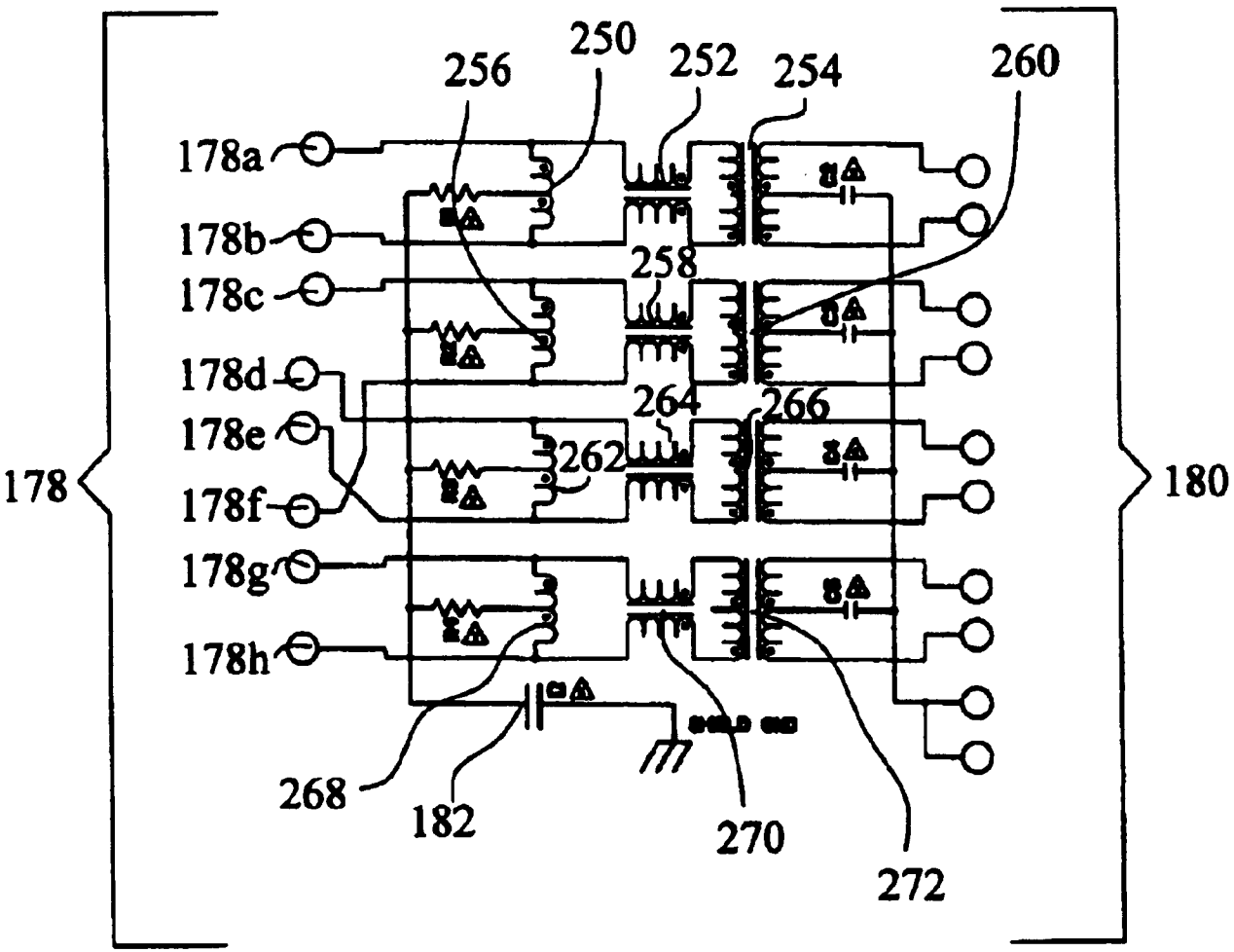
FIG. 21 is a schematic view of the circuitry for the signal conditioning.

As shown in FIG. 21, the input connections to the printed circuit board, that is the plated through holes are shown at 178. As shown, for each twisted pair set, the set passes through three magnetic coils, for example, for twisted pair set 178*a*, 178*b*, the set is coupled to magnetic coils 250, 252 and 254. Twisted pair set 178*c*, 178*f* is coupled to coils 256, 258 and 260. Twisted pair set 178*d*, 178*e* is coupled to coils 262, 264 and 266. Finally, twisted pair set 178*g*, 178*h* is coupled to magnetic coils 268, 270, 272. It should also be appreciated that each of the magnetic packages, described with reference to FIG. 5, contains a set of the three magnetic coils. Coils 250, 256, 262, and 268 function as a low impedance, common mode termination to ground coils 252, 258, 264, and 270 are common mode chokes; and coils 254, 260, 266, and 272 function as isolation transformers. In addition, the coils 250, 256, 262, and 268 are decoupled by decoupling capacitor at 182, and to ground through shielding foot 134.

Thus, the connector assembly functions as an excellent high speed connector, of low profile, due to the existence of the two-piece housing, where one piece (housing 4) is the connector mating profile and the other half (rear housing 6) provides the receiving area for the signal conditioning components. The two housings are then aligned and locked together, and then fully shielded.

As the shielding is defined in two portions, a front portion 8 enclosing the front housing 4, and a rear portion 10 enclosing the rear housing 6, the entire housing assembly can be shielded. Moreover, as the shield is two-piece, a foot portion 14 can integrally extend into the rear housing portion and be electrically connected to the decoupling capacitor and thus to ground. Preferably, the entire receiving area is thereafter potted, for example at 300, to totally seal and encapsulate the components and terminal connecting portions 164 therein.

What is claimed is:

1. An electrical connector having signal conditioning, the connector comprising:

an electrical connector housing assembly comprised of:

a front housing portion having a mating face for matingly receiving a complementary connector;

a housing component receiving portion having a receiving area for receiving signal conditioning components;

a plurality of electrical contacts, with mating contact portions adjacent said mating face for contact with the complementary connector, and connecting portions extending into said receiving area;

a plurality of signal conditioning components positioned in said receiving area;

a plurality of conductor portions positioned in said receiving area interconnecting said connecting portions and said signal conditioning components; and a shielding mechanism at least partially surrounding said electrical connector housing assembly, said shield member having a foot portion extending into said receiving area, and in electrical contact with at least one of said signal conditioning components.

2. The electrical connector of claim 1, wherein said front housing portion and said housing component receiving portion are separate housing portions.

3. The electrical connector of claim 2, wherein said shielding mechanism is comprised of a front shielding portion, surrounding said front housing portion, and a rear shielding portion, surrounding said component receiving housing portion.

4. The electrical connector of claim 3, wherein said front shielding portion is comprised of a plurality of shielding walls surrounding said front housing portion, with one of said shielding walls including said foot portion extending into said receiving portion.

5. The electrical connector of claim 4, wherein said rear shielding portion is comprised of a plurality of shielding walls surrounding said component receiving housing portion, said rear shielding portion being positioned adjacent to said contact foot to enclose said housing component receiving portion.

6. The electrical connector of claim 5, wherein said receiving area is defined by a floor and an upstanding perimeter wall, thereby defining an open upper face.

7. The electrical connector of claim 6, wherein said conductor portions are defined as circuit traces on a printed circuit board, with said signal conditioning components being positioned on said printed circuit board, with said perimeter wall being profiled to receive said printed circuit board therein.

8. The electrical connector of claim 6, wherein said connecting portions extend along, and are spaced from, a rear face of said front housing portion, whereby said front housing portion and said component receiving housing portion are assembled together, with a front wall portion of said upstanding perimeter wall extending between said connecting portions and said rear face of said front housing portion.

9. The electrical connector of claim 8, wherein said rear face is recessed and said side walls of said front housing portion partially overlap said perimeter wall.

10. The electrical connector of claim 8, wherein said front shield member is comprised of a rear wall shielding a portion of said connecting portions, and a tab portion extending from said rear wall and partially overlying said open upper face.

11. The electrical connector of claim 10, wherein said conductor portions are defined as circuit traces on a printed circuit board, with said signal conditioning components being positioned on said printed circuit board, with said perimeter wall being profiled to receive said printed circuit board therein.

12. The electrical connector of claim 11, wherein said contact foot extends vertically downward from said tab portion through said open upper face.

13. The electrical connector of claim 12, wherein said rear shielding portion includes a top shielding wall enclosing said open upper face, which extends to said tab portion, to define substantially enclosed seams.

14. A signal conditioned electrical connector comprising an electrical connector housing assembly comprised of a first housing portion having a mating face for matingly receiving a complementary connector, a second housing portion having a receiving area defined by a floor and an upstanding perimeter wall, for receiving signal conditioning components, a plurality of electrical contacts positioned on said first housing portion, having contact portions adjacent said mating face for contact with the complementary connector, and connecting portions extending into said receiving area, a plurality of signal conditioning components positioned in said receiving area, a plurality of conductor portions positioned in said receiving area interconnecting said connecting portions and said signal conditioning components, and a shielding mechanism at least partially surrounding said electrical connector housing assembly, said shield mechanism has a foot portion extending into said receiving area, and in electrical contact with at least one of said signal conditioning components.

15. The electrical connector of claim 14, wherein said front housing portion and said housing component receiving portion are separate housing portions.

16. The electrical connector of claim 15, wherein said shielding mechanism is comprised of a front shielding portion, surrounding said front housing portion, and a rear shielding portion, surrounding said component receiving housing portion.

17. The electrical connector of claim 16, wherein said front shielding portion is comprised of a plurality of shielding walls surrounding said front housing portion, with one of said shielding walls including a contact foot extending into said receiving portion.

18. The electrical connector of claim 17, wherein said rear shielding portion is comprised of a plurality of shielding walls surrounding said component receiving housing portion, said rear shielding portion being positioned adjacent to said contact foot to enclose said housing component receiving portion.

19. The electrical connector of claim 18, wherein said receiving area is defined by a floor and an upstanding perimeter wall, thereby defining an open upper face.

20. The electrical connector of claim 19, wherein said conductor portions are defined as circuit traces on a printed circuit board, with said signal conditioning components being positioned on said printed circuit board, with said perimeter wall being profiled to receive said printed circuit board therein.

21. The electrical connector of claim 19, wherein said connecting portions extend along, and are spaced from, a rear face of said front housing portion, whereby said front housing portion and said component receiving housing portion are assembled together, with a front wall portion of said upstanding perimeter wall extending between said connecting portions and said rear face of said front housing portion.

22. The electrical connector of claim 21, wherein said rear face is recessed and said side walls of said front housing portion partially overlap said perimeter wall.

23. The electrical connector of claim 21, wherein said front shield member is comprised of a rear wall shielding a portion of said connecting portions, and a tab portion extending from said rear wall and partially overlying said open upper face.

24. The electrical connector of claim 23, wherein said contact foot extends vertically downward from said tab portion through said open upper face.

25. The electrical connector of claim 24, wherein said rear shielding portion includes a top shielding wall enclosing said open upper face, which extends to said tab portion, to define substantially abutting seams.

* * * * *